US007627989B2

(12) United States Patent
Ootsuki et al.

(10) Patent No.: US 7,627,989 B2
(45) Date of Patent: Dec. 8, 2009

(54) DRIVE DEVICE FOR WIRE-TYPE WINDOW REGULATOR

(75) Inventors: Yasuo Ootsuki, Yokohama (JP); Hisato Tatsumi, Yokohama (JP)

(73) Assignee: Ohi Seisakusho Co., Ltd. (JP)

( * ) Notice: Subject to any disclaimer, the term of this patent is extended or adjusted under 35 U.S.C. 154(b) by 609 days.

(21) Appl. No.: 11/106,411

(22) Filed: Apr. 14, 2005

(65) Prior Publication Data

US 2005/0229493 A1 Oct. 20, 2005

(30) Foreign Application Priority Data

Apr. 16, 2004 (JP) ..... P2004-121887

(51) Int. Cl.
*E05F 11/48* (2006.01)

(52) U.S. Cl. ..... 49/352; 49/349

(58) Field of Classification Search ..... 49/348, 49/349, 352, 374

See application file for complete search history.

(56) References Cited

U.S. PATENT DOCUMENTS

| | | | | | |
|---|---|---|---|---|---|
| 4,191,060 | A | * | 3/1980 | Sessa | 74/89.22 |
| 4,503,732 | A | | 3/1985 | Schust | |
| 4,840,080 | A | * | 6/1989 | Kobayashi et al. | 74/501.5 R |
| 4,878,391 | A | | 11/1989 | Komatsu et al. | |
| 4,995,568 | A | * | 2/1991 | Yamagishi et al. | 242/125.1 |
| 5,564,231 | A | * | 10/1996 | Tajima et al. | 49/352 |
| 5,606,827 | A | * | 3/1997 | Kanou et al. | 49/352 |
| 6,009,671 | A | * | 1/2000 | Sasaki et al. | 49/352 |
| 6,094,868 | A | * | 8/2000 | Otaka et al. | 49/349 |
| 6,253,491 | B1 | * | 7/2001 | Pages | 49/352 |
| 6,305,129 | B1 | * | 10/2001 | Eckhardt et al. | 49/502 |
| 6,408,572 | B1 | * | 6/2002 | Uchimura et al. | 49/352 |
| 6,430,873 | B1 | * | 8/2002 | Borchuk et al. | 49/352 |
| 7,010,884 | B2 | * | 3/2006 | Yamamoto | 49/352 |
| 7,038,338 | B2 | * | 5/2006 | Sesselmann et al. | 310/83 |
| 7,044,412 | B2 | * | 5/2006 | Hemond et al. | 242/390.8 |
| 2005/0072050 | A1 | * | 4/2005 | Yamamoto | 49/352 |

FOREIGN PATENT DOCUMENTS

| | | | |
|---|---|---|---|
| DE | 8138613 | U1 | 6/1986 |
| DE | 19741691 | A1 | 7/1998 |
| DE | 19812875 | C1 | 6/1999 |
| JP | 2008-201288 | | 8/1988 |
| JP | 7-26837 | | 1/1995 |
| JP | 9-49369 | | 2/1997 |
| JP | 9049369 | * | 2/1997 |
| JP | 11-2069 | | 1/1999 |

* cited by examiner

*Primary Examiner*—Katherine W Mitchell
*Assistant Examiner*—Catherine A Kelly
(74) *Attorney, Agent, or Firm*—Kilpatrick Stockton LLP

(57) ABSTRACT

A drive device for a wire-type window regulator is disclosed wherein a drum is accommodated in a cover and, under such a status, rotating and operating a rotation operator, exposed to an operation bore portion, enables work to be done for winding a wire. With the rotation operator kept in engagement with operation bore portion, the drum is avoided from rotating in a rewinding direction, making it easy to perform work for an output shaft of a motor to be brought into engagement with a drive bore portion of the drum.

3 Claims, 5 Drawing Sheets

DRIVE DEVICE FOR WIRE-TYPE WINDOW REGULATOR

CROSS REFERENCE TO RELATED APPLICATIONS

This invention is based upon and claims the benefit of priority from Japanese Patent Application No. 2004-121887, filed on Apr. 16, 2004; the entire contents of which are incorporated herein by reference.

BACKGROUND OF THE INVENTION

1. Field of the Invention

The present invention relates to drive devices for a wire-type window regulator.

2. Description of the Related Art

Heretofore, in drive devices of wire-type window regulators for lifting and lowering window panels mounted to, for instance, vehicle doors has guide rails, fixedly mounted to the door, to be provided with a vertically movable carrier plate to which a window panel is fixedly secured. The carrier plate has been engaged with a wire stringed on the guide rails.

The wire has a portion wound on an outer circumferential periphery formed in a spiral form on a sidewall of a drum. The drum is accommodated in an inside of a cover formed with an inlet and outlet for the wire. The cover, formed with a cylindrical sidewall portion (inner wall) and top surface (inner wall) at a position near the outer circumferential periphery of the drum for precluding the dropout of the wire, is mounted on a motor fixedly secured to the guide rail. A bottom surface of the drum is formed with a hexagonal drive bore portion to which an output shaft, which has a shape corresponding to the drive bore portion, of the motor is inserted to be brought into engagement.

Such a drive device takes the form of a structure in that with the output shaft of the motor inserted to the drive bore portion, rotating the drum clockwise/counterclockwise with a drive force of the motor allows the carrier plate, engaged with the wire, to be vertically moved together with the window panel.

Winding-up work for winding up the wire on the drum is carried out by utilizing the drive bore portion of the drum prior to accommodating the drum in the cover. That is, a rotary shaft of a rotary tool is caused to engage the drive bore portion after which the drum is rotated by the rotary tool while winding up the wire on the outer circumferential periphery. Upon completion of winding-up work of the wire, the rotary shaft of the rotary tool is removed from the drive bore portion of the drum after which the drum is accommodated in the cover, upon which the output shaft of the motor is brought into engagement with the drive bore portion of the drum accommodated in the cover. When this takes place, with a view to precluding the rewinding of the wire on the drum within the cover during a period in which the output shaft of the motor is brought into engagement with the drive bore portion, a need arises for the drum to be pressed with a hand or the cover needs to be formed with a temporary clamp claw for preventing the antirotation of the cover (for instance, Japanese Patent Application Laid-Open Publication No. 11-2069).

BRIEF SUMMARY OF THE INVENTION

However, with such related art technology, due to the presence of a need to block the rotation of the drum during a period in which after the wire is wound on the drum, the drum is accommodated within the cover upon which the output shaft of the motor is brought into engagement with the drive bore portion of the drum, issues have arisen with troublesome work, resulting in a drop in work efficiency.

The present invention has been completed with such issues of the related art in mind and has an object to provide a drive device for a wire-type window regulator that makes it possible to easily carry out a series of work for assembling from a phase in which a wire is wound on a drum to a phase in which the drum is coupled to a motor.

To achieve the above object, a wire-type window regulator, of the present invention, comprises a motor serving as a drive source, a drum having an outer periphery formed with a recess in which a wire is wound, a cover having a top surface and an inner wall, formed in a cylindrical shape in cross section, by which a drum accommodating space is defined, wherein under a condition where the drum is accommodated in the drum accommodating space, the wire is wound between the inner wall and the recess of the drum to prevent dropout of the wire, a drive bore portion, formed in a bottom surface of the drum at a rotational axis thereof, which has a shape to correspond to a cross-sectional shape of an output shaft of the motor, a rotation operator formed at a rotation center of a top surface of the drum, and an operation bore portion formed in the top surface of the cover such that under a condition where the drum is accommodated in the cover, the rotation operator is exposed to an inside of the operation bore portion.

With such a structure, the drum accommodated in the cover can be rotated for winding up the wire on the drum by manually rotating and operating, or using an electromotive tool, the rotation operator of the drum, exposed to the operation bore portion, through the operation bore portion formed in the top surface of the cover while keeping the drum within the cover. Accordingly, it becomes easy to perform work for winding the wire. Also, leaving the rotation operator under engaged condition after completing the winding-up operation avoids the antirotation of the drum in a rewinding direction within the cover, making it easy for performing work for allowing the output shaft of the motor to be brought into engagement with the drive bore portion of the drum.

DETAILED DESCRIPTION OF THE INVENTION

Figure 1:
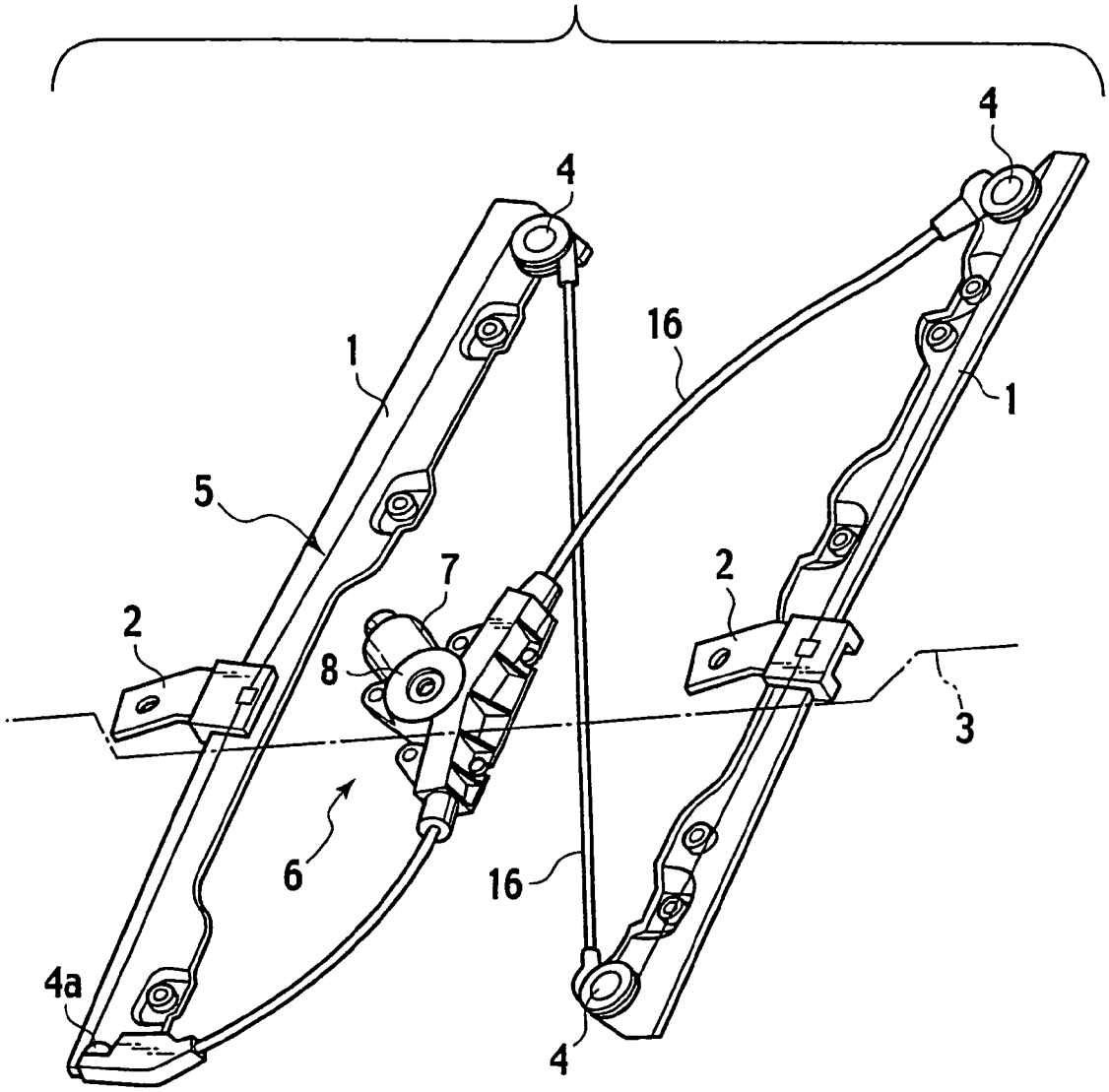
FIG. 1 is a perspective view showing a drive device for a wire-type window regulator of one embodiment according to the present invention.

Now, one embodiment of the present invention is described with reference to FIGS. 1 to 8. As shown in FIG. 1, fixedly secured to a pair of fore and aft guide rails 1 fixedly mounted on a door (not shown) are vertically movable carrier plates 2 to which a window panel 3 is fixedly secured.

Disposed on the guide rails 1 at upper and lower areas thereof are pulleys 4 and wire guides 4*a*, on which a loopshaped wire 5 is stringed. The carrier plates 2 engage with the wire 5 extending along each guide rail 1 to be vertically movable with the wire 5.

The wire 5 is arranged to extend in string segments crossing each other in an area between the pair of guide rails 1 and one of the string segments carries a drive device 6. The drive device 6 is comprised of a motor 7, a cover 8 and a drum 9.

The motor 7 is fixedly mounted to the guide rail 1 via a bracket (a fixing unit) that is not shown. The motor 7 is able to rotate an output shaft 10, formed in a quadrangle shape in cross section (see FIG. 6), in clockwise or counterclockwise directions. Mounted to the motor 7 is the cover 8 that includes an inner wall 11 and a top surface 12, which will be described later, by which a drum accommodating space S1 is defined to accommodate therein the drum 9.

Figure 2:
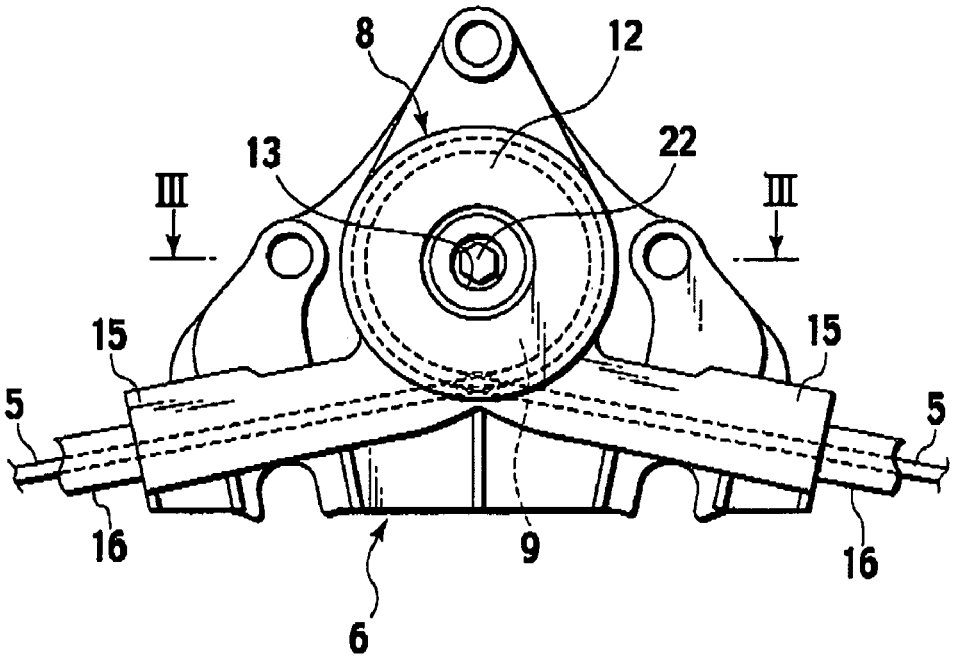
FIG. 2 is a plan view showing a cover shown in FIG. 1.

As shown in FIG. 2, the cover 8 has a whole shape formed in a substantially triangular configuration with its center formed in a structure that includes a sidewall, in which the inner wall 11 formed in a cylindrical shape in cross section is formed, and the top surface 12 by which a top of the cover 8 is closed. Formed at a center of the top surface 12 of the cover 8 is a circular-shaped operation bore portion (assembling through-bore portion) 13, and a cylindrical flange 14 (see FIG. 3) is formed in a way to extend from an inner peripheral edge portion of the operation bore portion 13 toward an inside of the cover 8. Formed in the cover 8 at upper and lower areas thereof are gateways 15 for the wire 5. The gateways 15 takes the form of recessed configurations that are formed on a bottom surface of the cover 8 to enable the wire 5 to be set in place from the bottom surface of the cover 8. Formed between the gateways 15 and each of the pulleys 4 of the guide rails 1 are tubes 16 that protect the wire 5 from damage while precluding the loosening of the wire 5.

Figure 3:
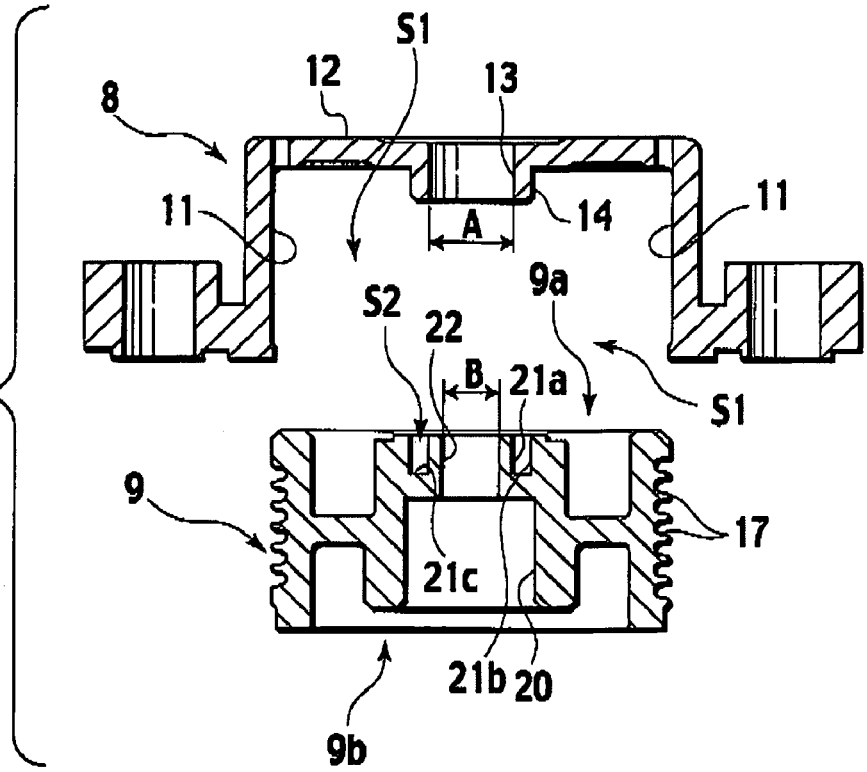
FIG. 3 is an exploded cross-sectional view taken along III-III of FIG. 2.
Figure 4:
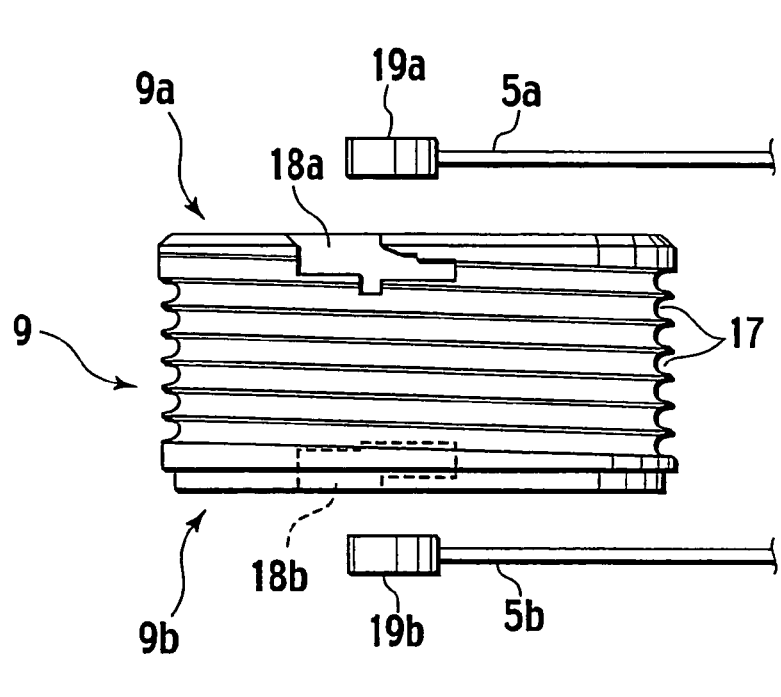
FIG. 4 is a side view showing a drum shown in FIG. 3.
Figure 5:
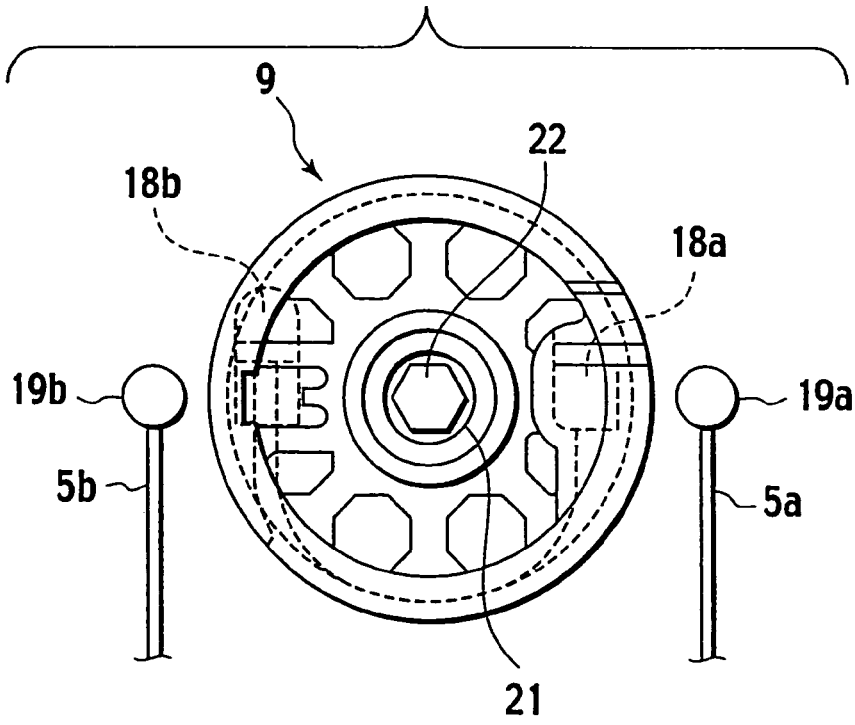
FIG. 5 is a side view showing the drum shown in FIG. 4.
Figure 6:
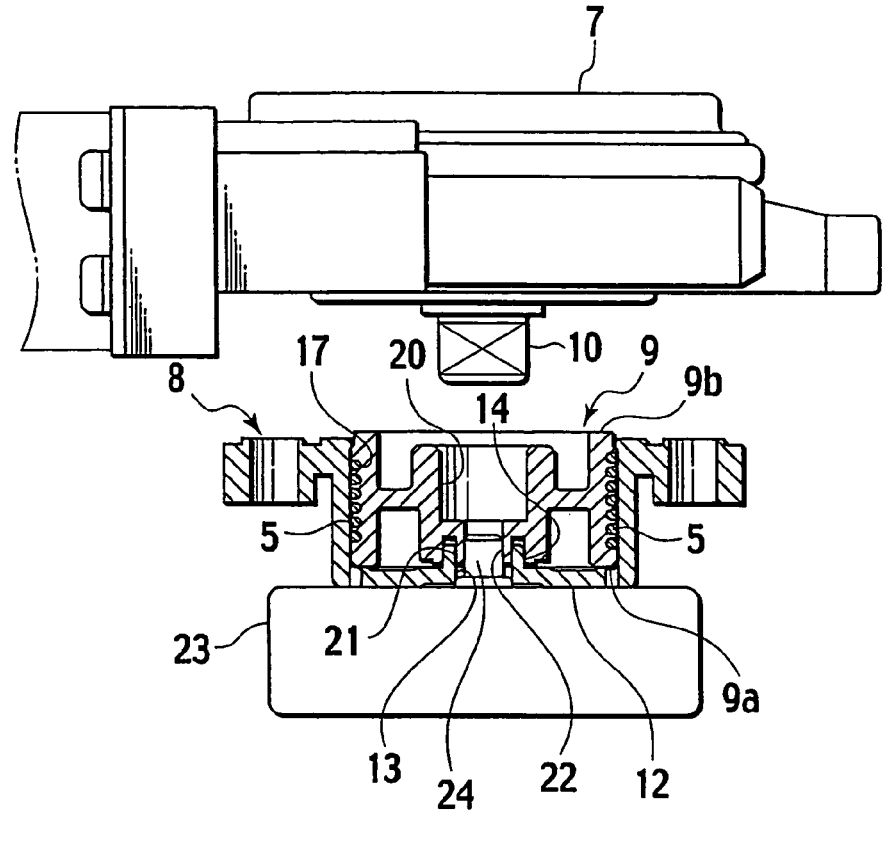
FIG. 6 is an exploded side view showing a wind-up condition of a wire of FIG. 2, with component parts partially in cross-section.
Figure 7:
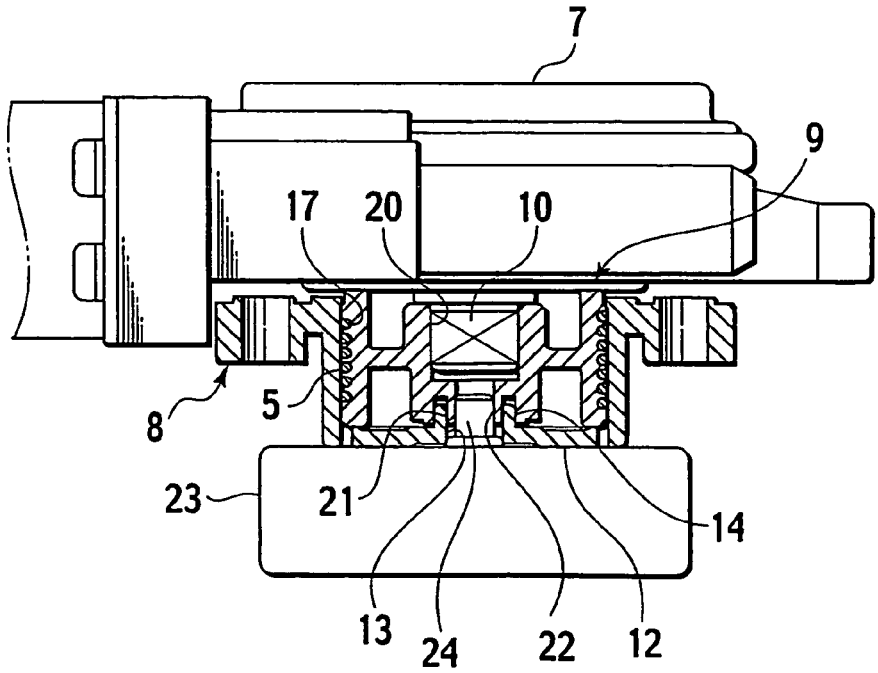
FIG. 7 is a side view showing a condition in which a motor is assembled to the drum shown in FIG. 6.

As shown in FIGS. 3 and 4, the drum 9, which is accommodated in the drum accommodating space S1 defined by the inner wall 11 of the cover 8 and the top surface 12, has a side face formed with a spiral outer circumferential recess 17. Further, the drum 9 has a top surface 9*a* and a bottom surface 9*b* that are formed with engagement pockets 18*a*, 18*b*, respectively. End portions 19*a*, 19*b* of both ends of the wire 5 are engaged with the engagement pockets 18*a*, 18*b*, respectively. As shown in FIGS. 6 and 7, under a condition where the drum 9 is accommodated in the cover 8, the presence of the spiral outer circumferential recess 17 of the drum 9 placed in close proximity to the inner wall 11 of the cover 8 prevents the dropout of the wire 5 from the spiral outer circumferential recess 17 within the cover 8.

Formed on the drum 9 at the bottom surface 9*b* is a drive bore portion 20 formed in a quadrangle shape in cross section for engagement with the output shaft 10 of the motor 7. Defined on the top surface 9*a* of the drum 9 is a space S2 to which the flange 14 of the cover 8 is fitted. In particular, the space S2 is formed in a schematically concave shape in side cross-section by an outer circumferential periphery 21*a* of an inner wall 22, which serves as a rotation operator 22, an opposed surface 21*b* facing the outer circumferential periphery 21*a*, and a bottom surface 21*c* through which the outer circumferential periphery 21*a* and the opposed surface 21*b* (see FIG. 3) are contiguous. With the presently filed embodiment, the rotation operator 22 has a hexagonal shape in cross section. Since the diameter B of the rotation operator 22 is smaller than the diameter A of the operation bore portion 13 of the cover 8, the rotation operator 22 is assembled in a state viewable from the operation bore portion 13 when the drum 9 is accommodated in the cover 8 (see FIG. 2). In addition, since the flange 14 is rotatably fitted to the space S2, the drum 9, accommodated in the cover 8, is able to rotate in a smooth fashion with no interference with peripheral movable parts. Also, the rotation operator 22 and the outer circumferential periphery 21*a* form a shaft portion 21, which will be described below.

Rotating the drum 9 clockwise or counterclockwise with the motor 7 allows a one end 5*a* of the wire 5 to be wound and the other end 5*b* of the wire 5 to be driven out. As a result of such movement, the wire 5 moves on the guide rails 1 upward or downward, enabling the carrier plates 2 to be vertically moved together with the window panel 3.

Figure 8:
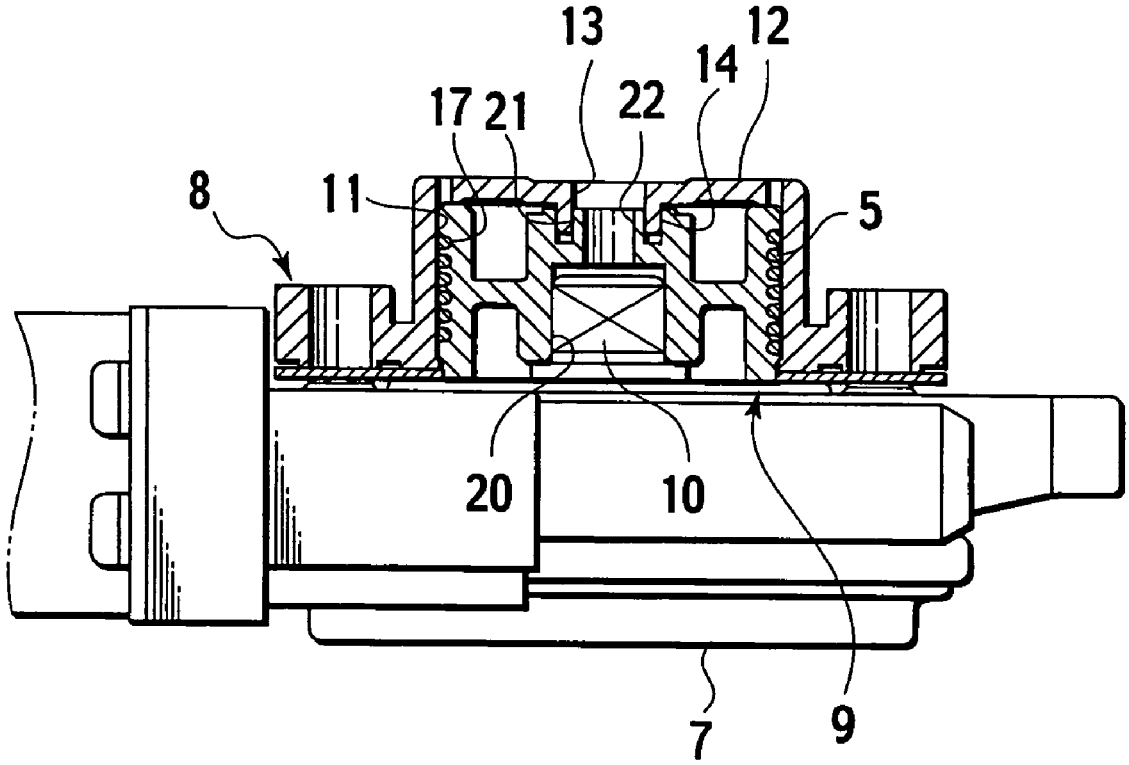
FIG. 8 is a side view showing a condition in which an assembled unit with the motor is placed upside down.

Next, description is made of how the drive device 6 is assembled with reference to FIGS. 6 to 8. The cover 8 is placed on an electric jig 23 upside down with the top surface 12 facing downward. A rotary shaft 24 is provided on the electric jig 23 in an upstanding direction. The rotary shaft 24, which has a hexagonal shape in cross section in conformity with the cross-sectional shape of the inside of the rotation operator 22, is inserted from the operation bore portion 13 toward the inside of the cover 8 and kept in a fixed condition.

Then, the drum 9 is accommodated in the space S1 of the cover 8 with the drum 9 kept upside down with respect to a direction in which the drum 9 is mounted in use. An end portion 19*a* of the one end 5*a* of the wire 5 is preliminarily engaged with the engagement pocket 18*a* formed in the area closer to the top surface 9*a* placed on a lower side. Accommodating the drum 9 in the cover 8 allows the flange 14, formed on the operation bore portion 13 of the cover 8, to be brought into engagement with the shaft portion 21 of the drum 9, thereby making it easy for the drum 9 to be accurately rotatable about an axis of the shaft portion 21. Since the flange 14 and the shaft portion 21 is able to form a rotary shaft for the top surface 9*a* of the drum 9, no need arises for preparing other separate rotary shaft members such as a clip, enabling achievement in reduction of the number of component parts.

When accommodating the drum 9 in the space S1 of the cover 8, the rotation operator 22 of the drum 9 is assembled in a manner to be exposed to the operation bore portion 13 of the cover 8 and the rotary shaft 24 of the electric jig 23, penetrating through the operation bore portion 13, is inserted to and fixed in the rotation operator 22 (see FIG. 6).

Under such a status, the rotary shaft 24 of the electric jig 23 is rotated, thereby winding up the one end 5*a* of the wire 5 on the outer circumferential periphery 17 of the drum 9. With the one end 5*a* of the wire 5 wound to allow the wire 5 to be applied with tension, the end portion 19*b* of the other end 5*b* of the wire 5 is engaged with the engagement pocket 18*b* on the bottom surface 9*b* of the drum 9. Thereafter, the drum 9 is rotated in the opposite direction to allow the one end 5*a* of the wire 5 to be wound, while winding up the other end 5*b* of the wire 5 upon which the winding of the wire 5 is terminated.

After the winding of the wire 5 has been terminated, the rotary shaft 24 of the electric jig 23 is not pulled out from the concave portion 22 of the drum 9 and the rotation of the drum 9 inside the cover 8 is prevented. Under a condition where the rotation of the drum 9 is blocked, the electric jig 23 causes the output shaft 10 of the motor 7 to be brought into engagement with the drive bore portion 20 of the drum 9 from the bottom surface 9*b* of the drum 9, thereby causing the motor 7 and the cover 8 to be coupled to each other (see FIG. 7). After the motor 7 and the cover 8 coupled to each other, the rotary shaft 24 of the electric jig 23 is pulled out of the rotation operator 22 of the drum 9. Then, a whole structure is inverted and the motor 7 is fixed to the bracket (not shown) supported on the guide rail 1 upon which work is completed (see FIG. 8).

With such an embodiment, rotating and operating the rotation operator 22 of the drum 9 with the electric jig 23, with the drum 9 accommodated in the cover 8, the drum 9 inside the cover 8 can be rotated to wind up the wire 5. Accordingly, it becomes easy for performing winding work for the wire 5. Moreover, with the rotary shaft 24 of the electric jig 23 and the rotation operator 22 kept in engagement with each other after the termination of winding work, the drum 9 is blocked from being rotated in a rewinding direction within the cover 8, enabling work to be easily performed for engaging the output shaft 10 of the motor 7 to the drive bore portion 20 of the drum 9.

While the embodiment, set forth above, has been shown with reference to an example in which the wire 5 is wound on the drum 9 with the cover 8 placed upside down, the cover 8 may not be placed upside down while the rotating operation may be carried out for the rotation operator 22, which is exposed to the operation bore portion 13 of the cover 8, using a manual tool under a condition where the cover 8 is held by a hand.

Since the rotation operator takes has the concave portion formed in the polygonal shape, the rotation operator can be easily formed and the rotation operator does not protrude from the operation bore portion outward of the cover with no fear of interference with the peripheral movable parts.

Of course, while the "rotation operator" has been exemplarily taking the hexagonal shape as an example, the "rotation operator" may take other shapes, such as a polygonal or non-circular concave portion whose rotation is operable, other than the hexagonal shape. Moreover, the "rotation operator" may not take the form of the concave portion 22 but a convex portion that protrudes outward from the operation bore portion 13.

According to the present invention, since the flange and the shaft portion are able to form the rotary shaft on the top surface of the drum, no rotary shaft portion, such as a separate member involving a clip, is needed, resulting in reduction in the number of component parts.

Further, while the presently filed embodiment has been described with reference to an example wherein the drive device is used for a regulator mechanism with two guide rails 1, the present invention may have an application to a drive device for use in a regulator mechanism with a single guide rail.

What is claimed is:

1. A wire window regulator comprising:

a motor serving as a drive source;

a drum having an outer periphery formed with a recess in which a wire is wound;

a cover having a top surface and an inner wall, formed in a circular shape in cross section, by which a drum accommodating space is defined, wherein under a condition where the drum is accommodated in the drum accommodating space, the wire is wound between the inner wall and the recess of the drum to prevent dropout of the wire;

a drive bore portion, formed in a bottom surface of the drum at a rotational axis thereof, which has a shape to correspond to a cross-sectional shape of an output shaft of the motor, said output shaft operatively received in said drive bore portion;

a rotation operator formed at a rotation center of a top surface of the drum, an inner wall of the rotation operator having a polygonal shape in cross section; and an operation bore portion formed in the top surface of the cover such that under the condition where the drum is accommodated in the cover, the rotation operator is exposed to an inside of the operation bore portion, a diameter of the rotation operator being smaller than a diameter of the operation bore portion;

wherein a rotary shaft, which has a polygonal shape in cross section in conformity with the cross-sectional shape of the inner wall of the rotation operator, inserted through the operation bore portion toward the inside of the cover and kept in a fixed condition.

2. The wire-type window regulator according to claim 1, wherein the operation bore portion is formed in a circular shape in cross section and formed with a flange protruding toward the drum and having a circular shape in cross section; and wherein an outer circumferential surface of the rotation operator, an opposed surface facing the outer circumferential surface, and a bottom surface between the outer surface and the opposed surface are interconnected to define a space of a concave shape in side cross-section to which the flange of the cover is fitted.

3. A drive device for the wire-type window regulator according to claim 1, wherein the rotation operator and the drive bore portion are disposed in a coaxial relationship with respect to each other.

* * * * *